US009010864B2

(12) United States Patent
Goeckel

(10) Patent No.: US 9,010,864 B2
(45) Date of Patent: Apr. 21, 2015

(54) WHEELCHAIR BACK MOUNTING ASSEMBLY

(75) Inventor: Gregory W. Goeckel, Belleville, IL (US)

(73) Assignee: Roho, Inc., Belleville, IL (US)

( * ) Notice: Subject to any disclaimer, the term of this patent is extended or adjusted under 35 U.S.C. 154(b) by 193 days.

(21) Appl. No.: 13/578,697

(22) PCT Filed: Jan. 28, 2011

(86) PCT No.: PCT/US2011/022883

§ 371 (c)(1),
(2), (4) Date: Sep. 11, 2012

(87) PCT Pub. No.: WO2011/100127

PCT Pub. Date: Aug. 18, 2011

(65) Prior Publication Data

US 2012/0326482 A1 Dec. 27, 2012

Related U.S. Application Data

(63) Continuation of application No. PCT/US2009/052677, filed on Aug. 4, 2009.

(60) Provisional application No. 61/086,994, filed on Aug. 7, 2008, provisional application No. 61/303,471, filed on Feb. 11, 2010.

(51) Int. Cl.

| | |
|---|---|
| ***A47C 7/00*** | (2006.01) |
| ***A61G 5/10*** | (2006.01) |
| ***A61G 5/12*** | (2006.01) |

(52) U.S. Cl.

CPC ..... *A61G 5/1067* (2013.01); *A61G 5/12* (2013.01); *A61G 2005/122* (2013.01); *A61G 2203/78* (2013.01); *Y10S 297/04* (2013.01)

(58) Field of Classification Search

USPC ..... 297/DIG. 4, 440.2, 452.2; 403/49, 386

See application file for complete search history.

(56) References Cited

U.S. PATENT DOCUMENTS 3,640,571 A * 2/1972 Keropian ..... 297/464
4,989,836 A * 2/1991 Hudson et al. ..... 297/391

(Continued)

FOREIGN PATENT DOCUMENTS

DE 102007037439 A1 2/2009
DE 202008016511 U1 4/2009

(Continued)

OTHER PUBLICATIONS

International Search Report and Written Opinion corresponding to PCT application No. PCT/US2009/052677 dated Nov. 13, 2009.

(Continued)

*Primary Examiner* — David E Allred

(74) *Attorney, Agent, or Firm* — Polster, Lieder, Woodruff & Lucchesi, L.C.

(57) ABSTRACT

A support mechanism (20) for mounting a wheelchair back to a wheelchair post including at least one generally horizontally extending support pin (30), the support mechanism (20) comprising a hanger arm (24) having a downwardly opening hook (26) defining an upper support point and a self-locking latch (34) pivotally mounting to the hanger arm (24), the latch defining a locking notch (40) and a stop notch (42), the latch (34) being pivotal between a locked position in which the latch locking notch (40) and the hook (26) define a substantially closed hole around the support pin (30) and an unlocked position in which the pin (30) is seated in the stop notch (42) such that the latch (34) is secured open so the hanger arm hook (26) can be connected to or removed from the wheelchair post support pin (30); the latch (34) is shaped and weighted such that the latch can be moved to the locked position under the force of gravity.

5 Claims, 14 Drawing Sheets

(56) References Cited

U.S. PATENT DOCUMENTS

| | | | | |
|---|---|---|---|---|
| 5,062,677 | A | 11/1991 | Jay et al. | |
| 5,088,672 | A * | 2/1992 | Neuendorf et al. | 248/218.4 |
| 5,364,162 | A | 11/1994 | Bar et al. | |
| 5,511,854 | A * | 4/1996 | Cordia | 297/393 |
| 5,556,168 | A | 9/1996 | Dinsmoor, III et al. | |
| 5,713,687 | A * | 2/1998 | Schworer | 403/49 |
| D394,366 | S | 5/1998 | Graebe et al. | |
| D407,353 | S | 3/1999 | Bar et al. | |
| D408,767 | S | 4/1999 | Bar et al. | |
| D412,685 | S | 8/1999 | Bar et al. | |
| D413,085 | S | 8/1999 | Bar et al. | |
| D413,841 | S | 9/1999 | Bar et al. | |
| 6,095,611 | A | 8/2000 | Bar et al. | |
| 6,474,743 | B1 | 11/2002 | Hanker et al. | |
| 6,623,080 | B2 | 9/2003 | Clapper | |
| 7,066,549 | B2 | 6/2006 | Dennon et al. | |
| 7,188,902 | B1 | 3/2007 | Chen | |
| 7,857,394 | B2 | 12/2010 | Whelan et al. | |
| 8,567,863 | B2 * | 10/2013 | Hetzel et al. | 297/284.4 |
| 8,590,977 | B2 * | 11/2013 | Bee et al. | 297/440.2 |
| 2003/0102706 | A1 * | 6/2003 | Float et al. | 297/440.2 |
| 2004/0066081 | A1 | 4/2004 | Dennon | |
| 2007/0085300 | A1 * | 4/2007 | Loewenthal et al. | 280/304.1 |
| 2008/0157581 | A1 * | 7/2008 | Whelan et al. | 297/440.2 |
| 2011/0080031 | A1 * | 4/2011 | Whelan et al. | 297/440.2 |
| 2014/0021763 | A1 * | 1/2014 | Goeckel et al. | 297/354.1 |

FOREIGN PATENT DOCUMENTS

| | | | |
|---|---|---|---|
| EP | 1974707 | A2 | 10/2008 |
| WO | 2009158326 | A2 | 12/2009 |

OTHER PUBLICATIONS

New Zealand Office Action received Jan. 13, 2014.

PCT/US2014/050692—PCT Notification of Transmittal of the International Search Report and the Written Opinion of the International Searching Authority, or the Declaration dated Nov. 24, 2014.

* cited by examiner

WHEELCHAIR BACK MOUNTING ASSEMBLY

CROSS REFERENCE TO RELATED APPLICATIONS

This application claims the benefit of U.S. provisional application Ser. No. 61/303,471, filed Feb. 11, 2010 and PCT/US2009/052677, filed Aug. 4, 2009, which claims benefit of U.S. provisional application Ser. No. 61/086,994 filed Aug. 7, 2008 and Ser. No. 61/097,574 filed Sep. 17, 2008 and International Application PCT/US2011/022883 filed Jan. 28, 2011 and published under International Publication No. WO 2011/100127, all of which are incorporated herein in their entirety by reference.

BACKGROUND OF THE INVENTION

The disclosure relates generally to mounting assemblies to secure wheelchair back supports to the canes of wheelchairs. In one aspect, the mounting includes a gravity-driven latch for attaching the mounting assembly to a support point or support post on the wheel chair canes. In a further aspect, the mounting assembly includes a mounting clamp support assemblies from which the support post extends.

Wheelchairs generally comprise a frame with surface engaging wheels, a seating surface and a back support. The frame usually is made from tubular steel or the like. The seat and back can be a more pliant or flexible material such as vinyl or canvas for example. The frame includes two spaced apart upright members behind the seat, sometime referred to as posts or canes. The back support usually is suspended in a generally vertical orientation between the canes.

In many cases the original back support does not provide sufficient or appropriate support, or is not positioned in between the wheel chair posts, to meet the seated user's specific physical needs or tastes. The user may replace the original equipment back support with another back support, for example a more versatile or adjustable back support or one that is more rigid or firmer. These back supports can be attached to the original equipment canes or the canes can be removed and the replacement back installed.

Known back rests and mounting assemblies for back rests are complex and do not always allow for simple adjustment of the back rest, for example, without a tool. They generally include a back and do not provide for a mounting assembly that can be used to mount different back supports between the wheel chair canes. Moreover, they generally have a number of different adjustment points that must be operated to vary the angular position, vertical position and horizontal position or location of the back relative to the seat. It would be advantageous, therefore, to have a mounting assembly for a wheelchair back that can be used with different backs, that can allow for adjustment of the back in a plurality of ways using a single adjustment point and that can be adjusted without the use of tools.

Also, most currently available mounting assemblies for the wheel chair back rests do not allow for attachment to wheelchair canes without a tool. Additionally, currently available mounting assemblies do not allow for the mounting assembly to be securely connected to the wheelchair support posts when the mounting assembly is not locked or fastened to the support posts. Therefore, it would be advantageous to have a mounting assembly for a wheelchair back that can be easily unlocked using one hand without a tool and that can be securely connected to support posts on the wheelchair canes even in an unlocked position.

The mounting clamps of wheelchair posts of the prior art generally do not provide multiple support locations for the mounting assembly in a single clamp. They generally require the use of multiple clamps per wheelchair post and multiple loose parts for each clamp. It would be advantageous to employ a clamp that can be manipulated with one hand, without tools, that comprises fewer loose parts that may become inconveniently disengaged or even lost.

BRIEF SUMMARY

A mounting assembly is provided including a support mechanism for mounting the wheelchair back to support posts extending substantially horizontally from the wheelchair canes. The support mechanism is operable without the use of tools, and allows for one-handed attachment of the wheelchair back to the support posts and one-handed removal of the wheelchair back from the support posts. The support mechanism can be engaged in a locked position by gravity and released into and secured in an unlocked position by lifting up on a handle.

In another aspect of the invention, the support mechanism includes a hanger arm having a hook at the upper end defining an upper support point and a self-locking latch pivotally mounting to the hanger arm. The hook is a downwardly opening hook. The latch defines a locking notch and is pivotal between a locked position in which the locking notch and the hanger arm hook define a substantially closed hole around the support post and an unlocked position such that the hanger arm hook can be connected to or removed from the support post. The latch is shaped and weighted such that the latch will move to the locked position around support posts under the force of gravity when the back is installed between wheelchair canes. The latch can be moved from the locked position to the open position without the use of a tool. The latch further comprises a handle member which is graspable and lifted up so as to pivot the latch from the locked position to the unlocked position. The body of the latch is orientated away from the wheelchair back and canes leaving more clearance for moving the seat back backwards between the canes.

In accordance with a further aspect of the support mechanism, the latch includes a second or stop notch positioned on the latch to be generally vertically aligned with the hanger arm hook when the latch is rotated up to the unlocked position. The stop notch engages the support post when the latch is lifted to an open position such that the hook still securely engages the support post against inadvertent removal of the wheelchair back when the latching mechanism is in the unlocked position.

A further aspect of the invention provides a ramp or camming surface on the latch that allows the latch to move to an open position when it is urged against the support posts and then rotate into a closed position around the post under its own weight to allow for simple, single handed attachment between the wheelchair canes.

In another aspect, a mounting clamp which is secured to the wheelchair canes and from which the support post extends is provided that is simple in construction, has fewer loose parts, that provides at least one support point, and that can be easily disassembled and adjusted to accommodate canes of various diameters with or without the use of a tool. The mounting clamp includes a mounting clamp block and an associated C-shaped band that is positioned around the wheelchair cane. The band has a first arm and a second arm. The first arm of the band is hingedly attached to a first end of a barrel pin that extends through aligned openings in the sides of the clamping block. The second arm includes an opening that seats the second end of the pin. A fastener, generally a set screw or adjustment bolt, is threadedly engaged through the clamping block and the pin. To attach the band to the cane the adjustment bolt is loosened and the second arm of the band is disengaged from the second end of the pin and swung open about the hinge. The mounting clamp block is positioned against the cane and the band is swung back around the cane and the second arm of the band is secured to the second end of the pin. The adjustment bolt is tightened until the pin draws the band toward the block to impinge the cane between the clamp block and band securing the mounting clamp to the cane.

In a further variation of the clamp assembly, the clamp assembly includes a second point of support. In accordance with this variation, the clamp assembly can include elongated extension member extending downwardly from the clamp block. The extension member has a forward surface shaped complimentary to, and which is flush with, the clamp block forward surface, such that the extension member lengthens the forward surface of the clamp block. The second support post is positioned at a lower end of the extension member, the second point of support comprising a second support post. In this embodiment, the clamp block includes a support post extending from one side. The clamp block includes a first side and a second side. The recited sides have complementary openings. A pin is positioned through the openings. The pin has a first or free end and a second end. A generally C-shaped flexible band having a first or free arm with an opening and a second arm that is hingedly attached to the second end of the pin. The clamp block includes and opening for threaded engagement of a fastener. There is a hole in the pin for threaded engagement of the fastener. The flexible band can be opened to secure to an object such as a wheelchair cane by pivoting the band about the hinge. The band is then pivoted back around and the free end of the pin is seated in the free arm of the band. Rotation of the fastener in the pin draws the band toward the block.

In accordance with a further aspect, a mounting clamp assembly is provided from which the support post extends. The mounting clamp assembly comprises a clamp block, a flexible band having a generally C shape defined by a first and second arm, a pin extending through the clamp block and a fastener. One arm of the band is hingedly attached to the pin at a point adjacent one side of the block and at the approximate midpoint of the pin. The free or opposite arm of the flexible band is secured to one end of the pin adjacent the opposite side of the clamp block. The clamp block has a rear surface defining a hole, a forward surface which is generally V-shaped, a first side surface and a second side surface. The first and second side surfaces of the clamp block have aligned openings. The pin extends through the openings in clamp block. The band is pivoted around the hinge and opened to be placed around a wheelchair cane or other object. The band can be pivoted back around the hinge and secured to the pin. The band thus extends around the forward surface of the clamp block to define a space between the clamp block forward surface and the band for the wheelchair cane. The pin has a bore in functional alignment with the hole in the rear surface of the clamp block. The fastener extends through the clamp block rear surface hole and is operatively engaged with the bore of the pin. At least one of the pin bore and the hole in the rear surface of the clamp block is threaded, such that rotation of the fastener in a first direction draws the band toward the forward surface of the clamp block to reduce the size of the space between the band and the clamp block forward surface in order to secure the wheelchair cane between the band and the forward surface of the clamp block; and rotation of the fastener in an opposite direction moves the band away from the forward surface of the block. The pin has a length greater than a width of the clamp block and extends beyond the point where the band arm is hingedly attached, such that the end of the pin extends beyond one of the side surfaces of the clamp block when the pin is received in the block to define the support post.

In another embodiment, one end of the clamp pin extends beyond one of the side surfaces of the clamp block when the pin is received in the block to define the support post. However, one arm of the band is hingedly attached to the clamp pin at the opposite end of the pin and adjacent the block. This embodiment of the clamp functions similarly to the previously described embodiment

DETAILED DESCRIPTION

Figure 1:
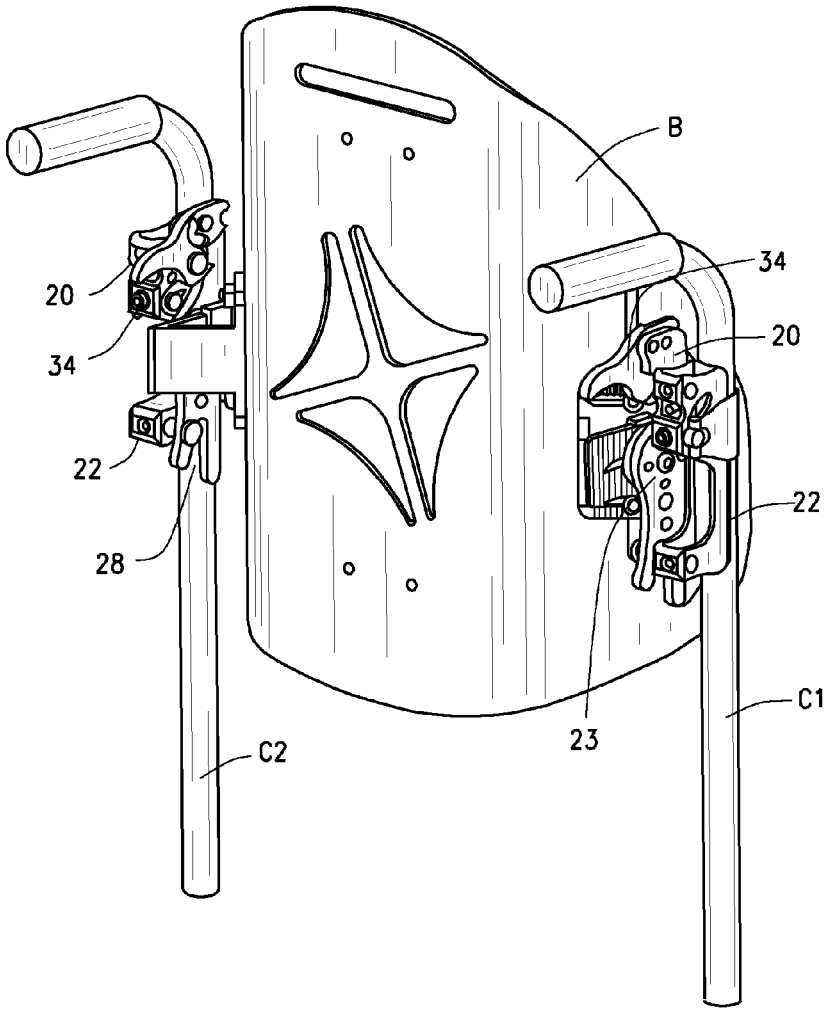
FIG. 1 is a rear perspective view of a wheelchair back attached to a pair of wheelchair canes with a pair wheelchair back mounting assemblies and one embodiment of an associated clamp assembly of the present invention.
Figure 2:
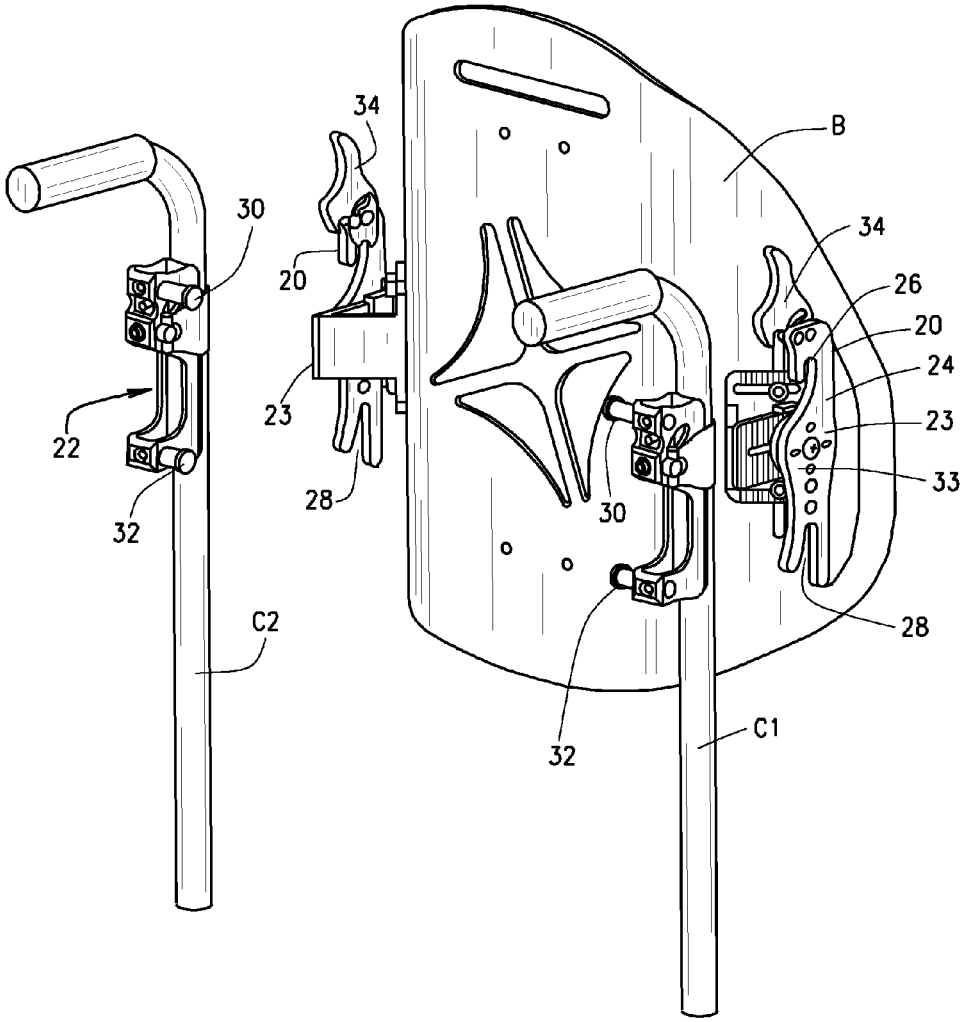
FIG. 2 is a rear perspective view thereof with the wheelchair back mounting assemblies unlatched and the wheelchair back removed from the canes.

The wheelchair mounting assembly and one embodiment of the clamp and mounting post assembly of the present invention are indicated by reference numerals 20 and 22 respectively in FIGS. 1 and 2. A mounting assembly 20 is attached to each side of a wheelchair back B. Wheelchair back B is positioned between wheelchair canes C1 and C2. It will be appreciated from FIG. 1 that one object of the wheelchair mounting assembly 20 is to provide means for mounting a wheelchair back B to the canes C1 and C2. It will be noted that the mounting assemblies 20 on each side of the wheelchair back B are mirror images. The wheelchair back B can be of any acceptable construction and can employ a rigid back or shell and a pad or cushion on the front side to provide a comfortable resting area for a user of the wheelchair.

As an initial matter, mounting assembly 20 includes an adjustment apparatus, indicated generally by reference number 23. Adjustment apparatus 23 allows for varying the position of the wheelchair back relative to the canes and the wheelchair seat. The construction and operation of the adjustment apparatus is described in detail in assignee's PCT/US2009/052677, filed Aug. 4, 2009, the disclosure of which is incorporated herein by reference.

Mounting assembly 20, shown in detail in FIGS. 1 through 8, includes a hanger arm 24. Hanger arm 24 includes a top support point, which in the illustrated embodiment is hook 26. Hook 26 is sized and shaped to engage or hang on an upper support post 30. Hanger arm 24 also includes a lower support point or fork 28. Lower fork is sized and shaped to engage a lower support post, such as lower support post 32. Hanger arm 24 includes a rounded midsection 33 that comprises part of the adjustment apparatus described in detail in PCT/US2009/052677. It will be noted that the described support posts 30 and 32 can be a component of a clamp and post assembly, such as clamp and post assembly 22 or another type of clamp and post assembly, such as clamp and post assembly 92, shown in FIG. 3, of which representative examples will be described in detail hereinafter.

Mounting assembly 20 includes a latching mechanism 34. Latching mechanism 34 includes a body section 36 that includes an arcuate opening 38, a first or primary locking notch 40 and a second or stop notch 42. A handle portion 44 extends from the body. It will be noted, particularly in FIG. 3, that the body and handle particularly the handle of the latching mechanism are orientated away from the wheelchair back. This is advantageous in that it allows the wheelchair back additional clearance to be moved backward between the canes, as described in PCT/US2009/052677.

Figure 4:
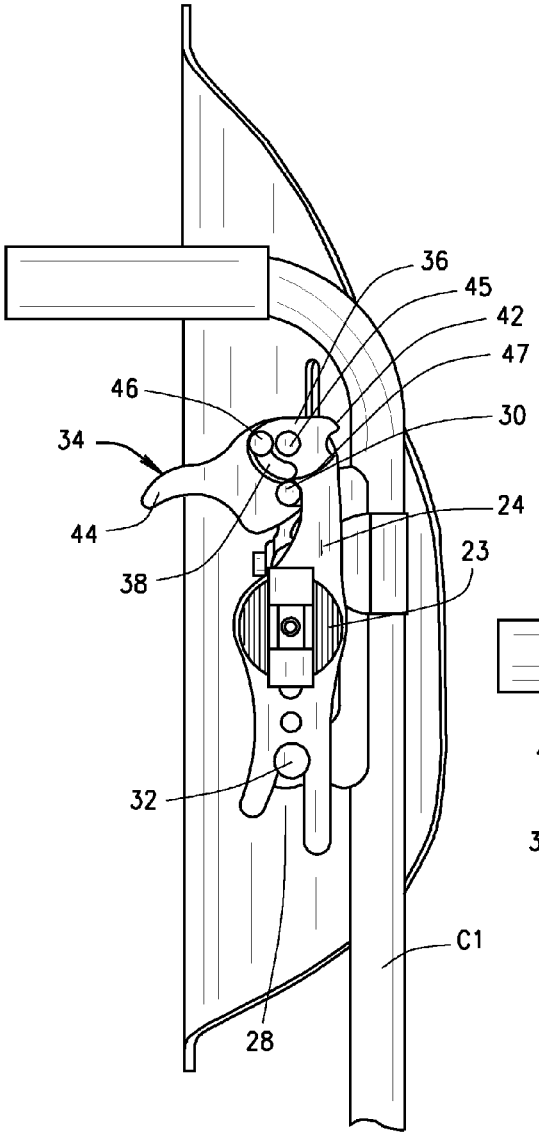
FIG. 4 is a side view of the wheelchair back with the mounting assembly fully engaged with a mounting clamp support post.

In any event, latching mechanism 34 is rotatingly attached to the upper hook area of the hanger arm by a pivot pin 45. A lug 46 extends into arcuate opening 38 to limit the rotation of the latching mechanism around the pivot pin. As best seen in FIG. 4, when the latching mechanism is in a closed or locked position hook 26 and first notch 40 encircle post 30 to securely attach the wheelchair back to the upper post. Correspondingly, fork 28 rests on lower support post 32. Latching mechanism 34 can be easily installed on support posts, even with one hand. First, fork 28 is positioned on lower support post 32. Wheelchair back B is moved toward upper post 30. Latching mechanism 34 includes a camming surface 47 which abuts the support post. Minimal effort is required to move the latching mechanism toward the post so as to rotate the latching mechanism to an open position until post 30 seats in first notch 40. Once the support post is in the first notch, the latching mechanism falls under its own weight so that notch 40 and hook 26 encircle post 30 to secure the hanger arm to the upper post. It will be appreciated that in an alternative design a spring or other similar structure can be interposed between the latching mechanism and the hook, for example, to bias the latching mechanism in a closed position.

Figure 5:
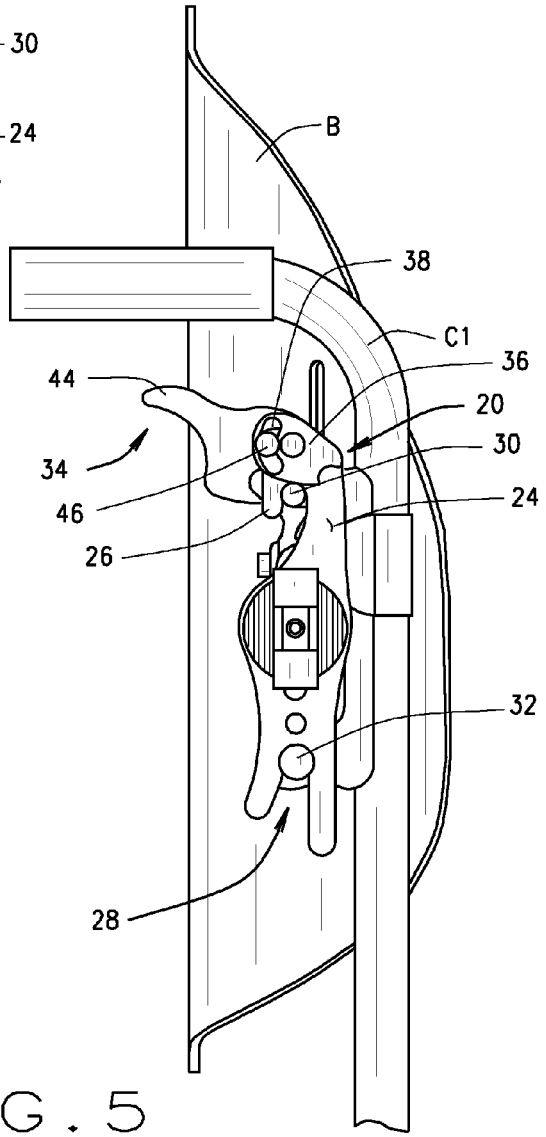
FIG. 5 is a side view of the wheelchair back with the mounting assembly in a partially engaged state with the mounting clamp support post.
Figure 6:
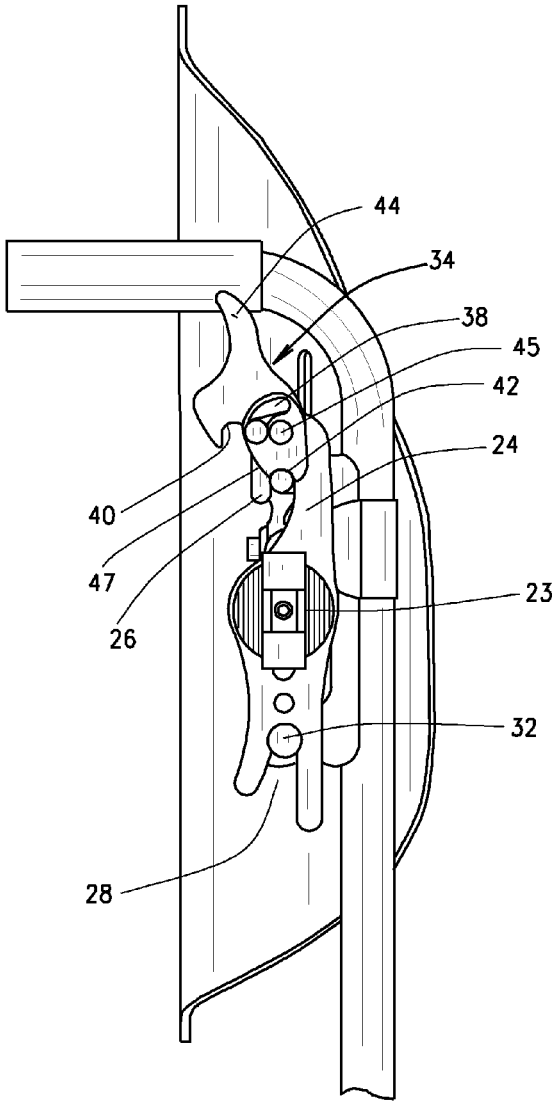
FIG. 6 is a side view of the wheelchair back with the mounting assembly rotated to an open position to allow removal from the support posts.

To release the wheelchair back from the support posts, handle 44 is lifted and latching mechanism 34 rotates about the pivot point 45 as shown sequentially in FIGS. 5 and 6. When the latching mechanism is completely raised, and lug 46 is at the end of arcuate opening 38, as shown in FIG. 5, upper support post 30 seats in second notch 42 such that the latching mechanism is held is a substantially vertical position. This is important since the latching mechanism would close under its own weight if the upper post were not seated in the second notch to secure the latch in an open position. Consequently, even with one hand a user can open the latch on one side of the back and then open the latch on the opposite side of the back.

It will be noted that if the embodiment included a spring between the latching mechanism and the hook sufficient force must be applied to overcome the biasing force of the spring. However, the biasing force of the spring would not be so great so as to dislodge post 30 from second notch 42.

Figure 7:
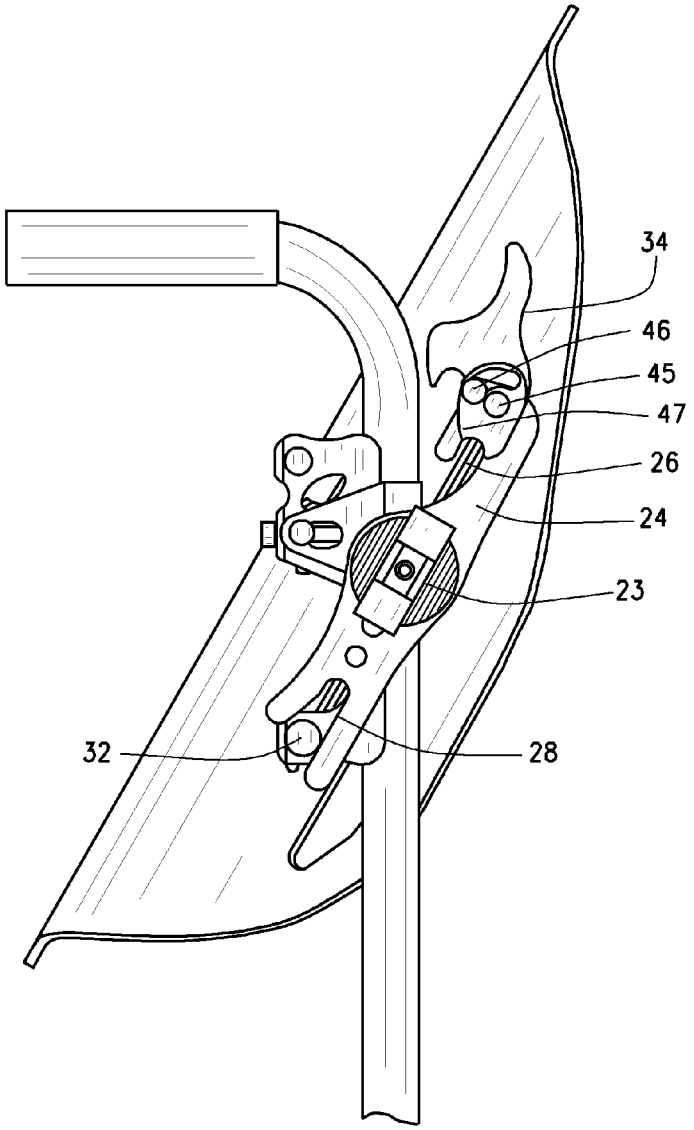
FIG. 7 is a side view of the wheelchair back with the mounting assembly disengaged from the top support post and the wheelchair back tilted for removal of the mounting assembly from the bottom support post.
Figure 8:
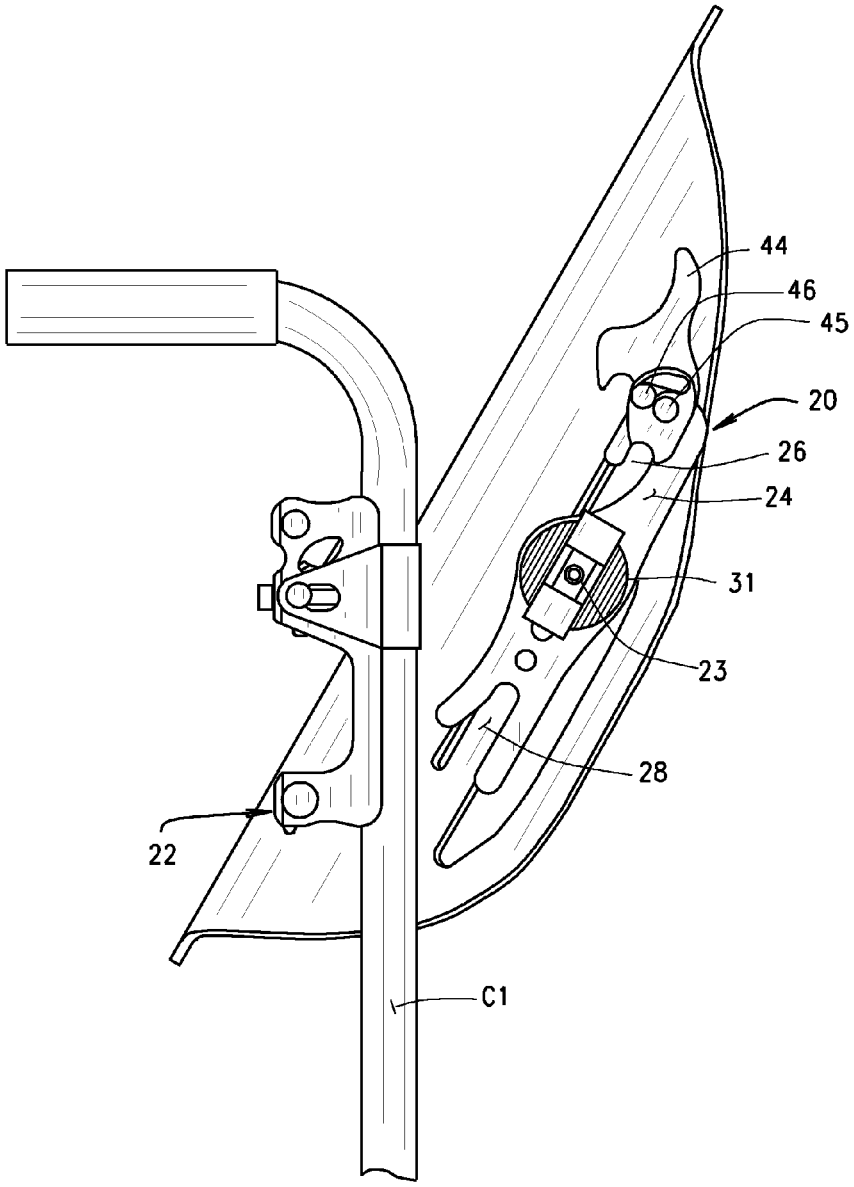
FIG. 8 is a side view of the wheelchair back with the mounting assembly disengaged from the top and bottom support posts.
Figure 9:
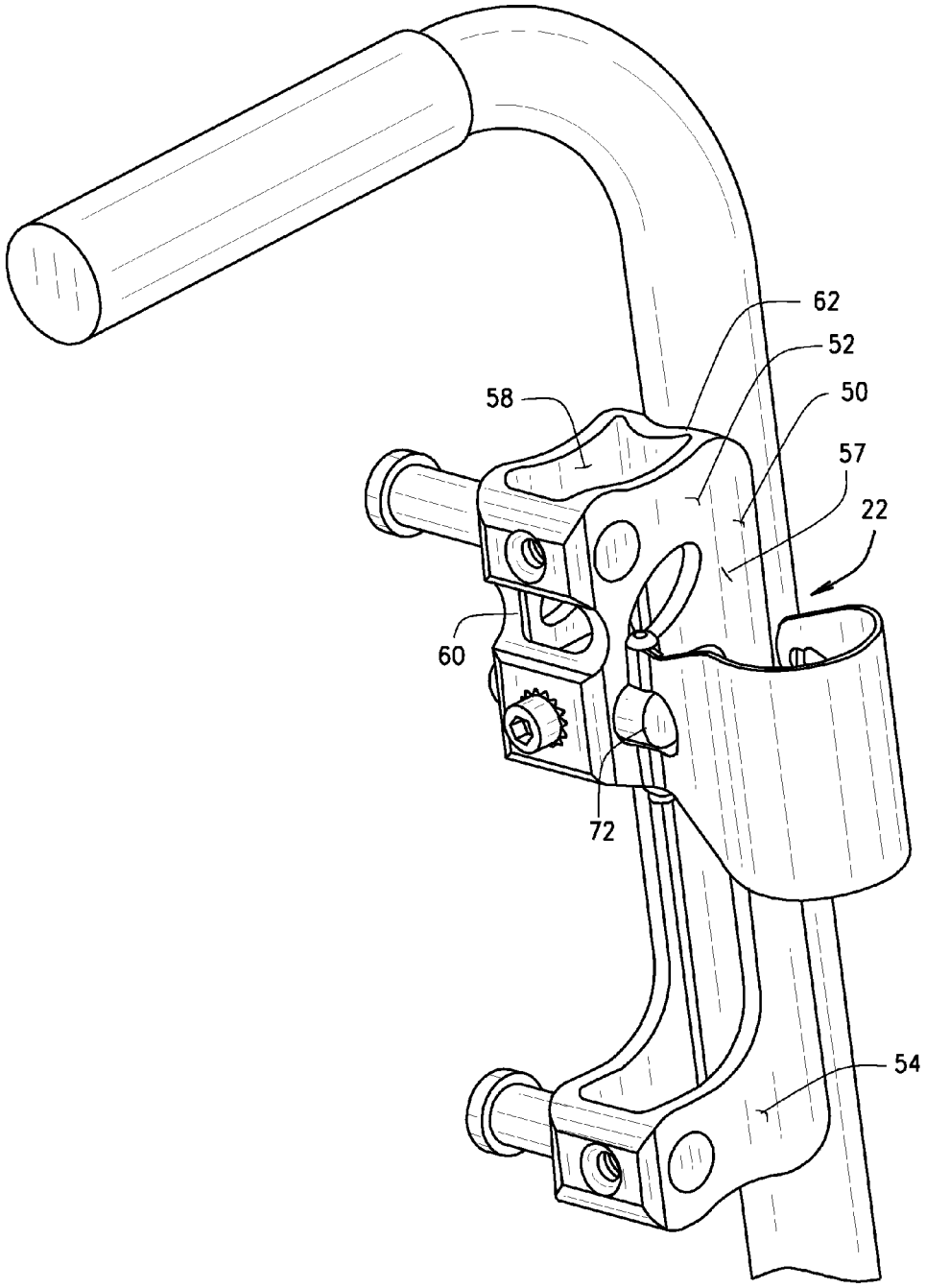
FIG. 9 is an enlarged perspective view of another embodiment of a clamp and post assembly on a wheelchair cane employing a top and bottom support post, with the flexible band rotated to an open position.
Figure 10:
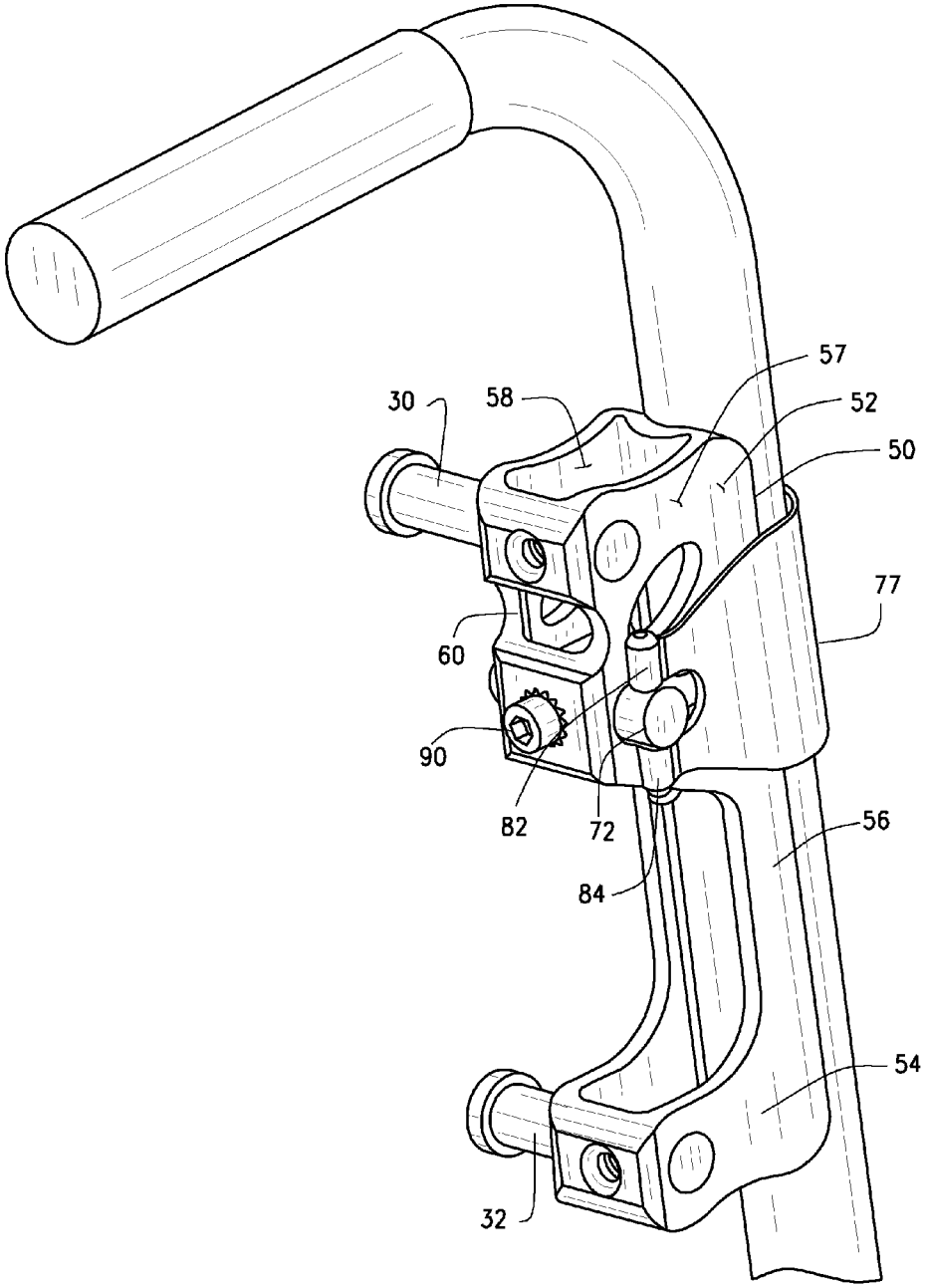
FIG. 10 is an enlarged perspective view thereof with the flexible band rotated to a closed position.
Figure 12:
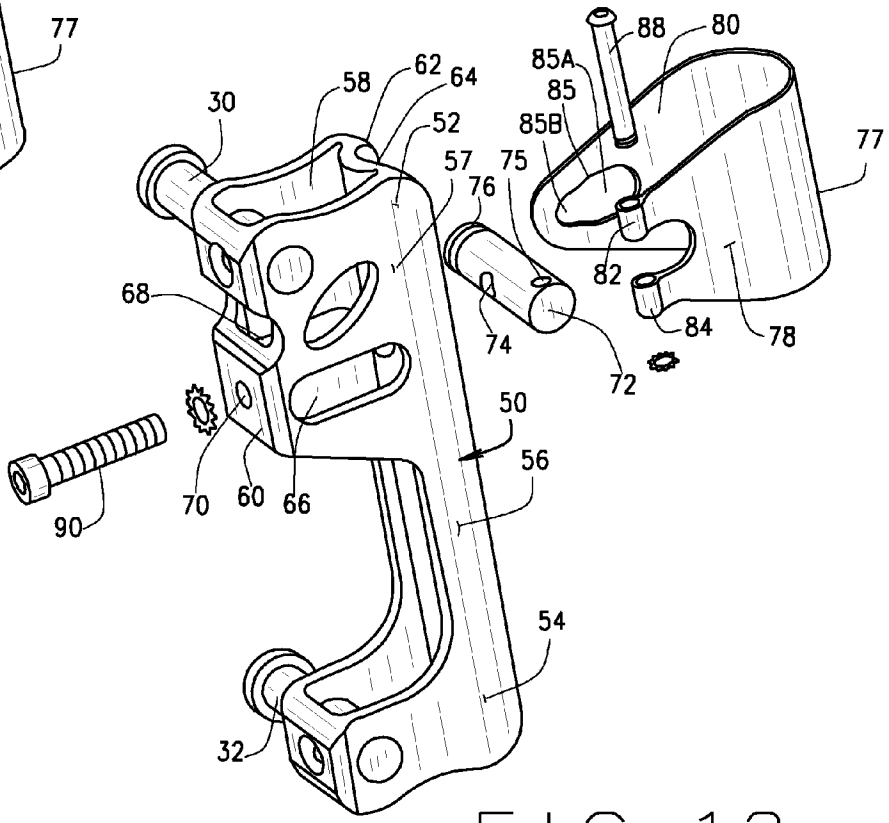
FIG. 12 is a fully exploded view thereof.
Figure 11:
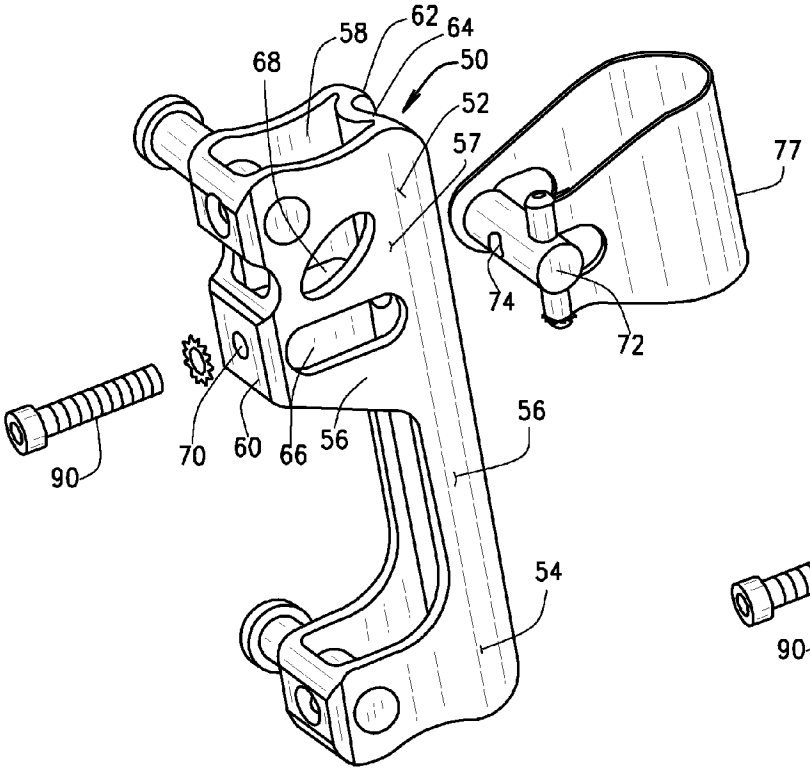
FIG. 11 is a partially exploded view of the clamp and post assembly of FIGS. 9 and 10.

In any event, it will be noted that even with latching mechanism 34 disengaged wheelchair back B will not completely disengage from the canes, an important safety feature. Hook 26 remains suspended on upper post 30 and fork 28 remains engaged on lower post 32. Although disengaged, latching mechanism 34 helps stabilize the back in this position due to the fact that upper post 30 is seated in second notch 42. As best seen in FIGS. 7 and 8, once the latching mechanism is released and hook 26 is disengaged from the top post 30 on each side of the wheelchair back, the back can be lifted to disengage fork 28 from the lower post 32 to completely remove the wheelchair back B from between the canes.

Mounting post assembly 22 is shown in greater detail in FIGS. 9 through 12. In this embodiment, mounting post assembly includes a generally rectangular block 50 that includes an upper block segment 52 and a lower block segment 54 connected by an elongated body segment 56. Block 50 can be constructed as a single piece from an appropriate, durable, lightweight material such as cast, extruded or machined aluminum, plastic or other appropriate material. Block 50 includes a first side wall 57, a second side wall 58, a rear wall 60 and a forward wall 62. It will be noted that forward wall 62 has a substantially V-shaped cross-section creating indention 64. There is an elongated hole or slot 66 in the first side wall of the upper block segment and a complementary elongated slot 68 in the second side wall of the upper block segment. There is a hole 70 in the rear wall. The hole can be threaded or smooth.

A barrel pin 72 extends through the elongated slots 66, 68. Pin 72 includes a generally centrally placed threaded hole 74, a pivot pin hole 75 at a first end and circumferential groove 76 in the surface of the second end. The mounting post assembly includes a flexible, generally C-shaped band 77. Band 77 includes a first arm 78 and a second arm 80. The first arm includes a pair of linearly aligned pin sleeves 82 and 84. The second arm includes an elongated opening 85 that has a major width 85A and a minor width 85B. The first arm of band 77 is attached to a first end of pin 72 by a pivot pin 88 that extends through the pin sleeves 82 and 84 and engages hole 75 in the first end of the pin. A threaded fastener 90 extends through hole 70 and engages threaded hole 74 of the barrel pin 72. As shown in FIG. 8, band 77 can be opened by rotating the band around the pivot pin 88. The opened band allows the assembly to be attached to a wheelchair cane C1. The band is then pivoted back around the cane until the second end of pin 72 is engaged in opening 85 of the second arm of band 77 with circumferential groove 76 secured in the minor width 85B of the opening 85 to secure the band in place. Fastener 90 then is rotated, urging the band toward block 50 until the assembly is tightly secured to the cane. The V-shaped cross-section of the forward wall allows the assembly to engage wheelchair canes or other posts of variable diameters. In the illustrated embodiment, upper post 30 extends laterally from the upper block segment and lower post 32 extends laterally from the lower block segment 54. The mounting assembly of the present invention is secured to the upper and lower posts as previously described.

Figure 3:
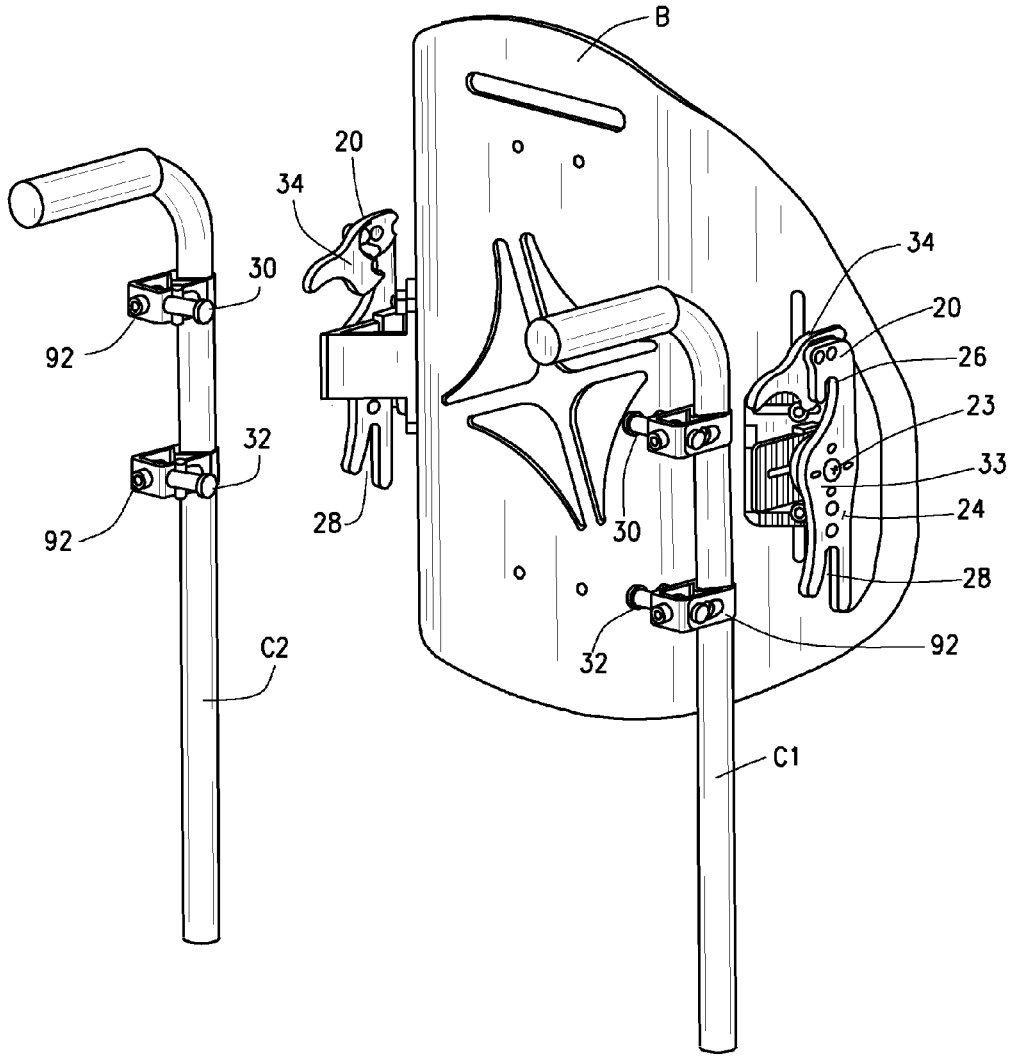
FIG. 3 is a rear perspective view of the wheelchair back mounting assemblies unlatched from another embodiment of associated clamp assemblies and the wheelchair back removed from the canes.
Figure 13:
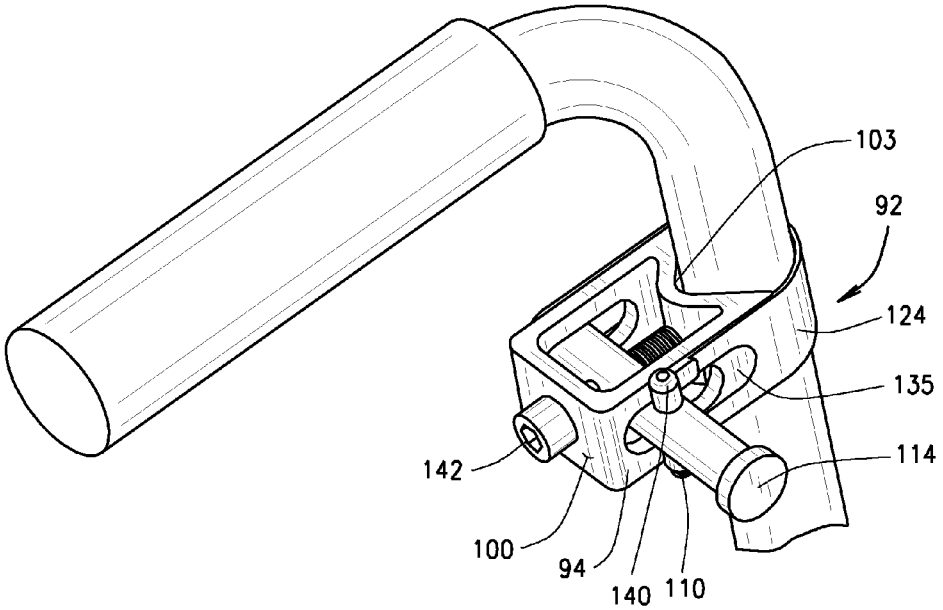
FIG. 13 is a perspective view of one embodiment of a mounting clamp and support post assembly attached to a wheelchair cane.
Figure 14:
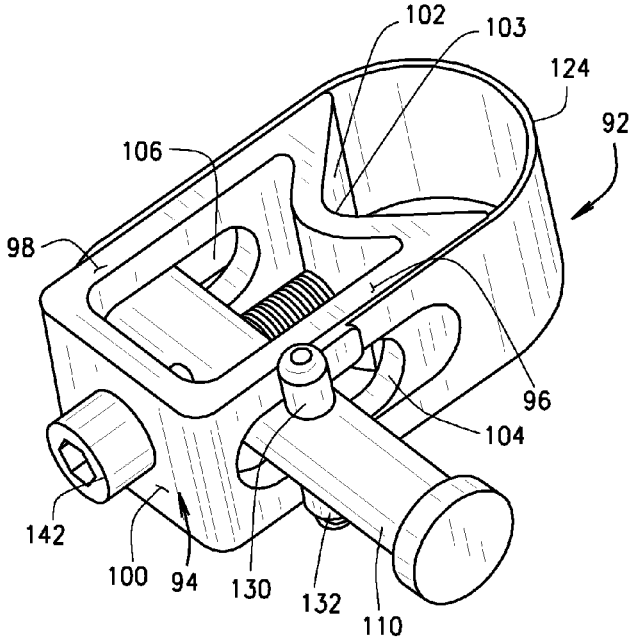
FIG. 14 is an enlarged perspective view of the embodiment of the mounting clamp of FIG. 13.

FIGS. 13 through 16 illustrate another embodiment of a mounting post assembly of the present invention, indicated generally by reference number 92. FIGS. 3 and 13 shows a mounting post assembly 92 attached to the upper end of a wheelchair cane C. Mounting post assembly 92 generally comprises a block 94 having a first side wall 96, a second side wall 98, a rear wall 100 and a forward wall 102. Forward wall 103 has a substantially V-shaped cross-section defining an indentation which allows the block to seat securely against canes of various diameters. The first and second side walls include aligned, complementary elongated openings 104 and 106, respectively. There is an opening or hole 108 in the rear wall. Assembly 92 further includes a post 110 having a first end 112 with a knob 114 and a second end 116 having a circumferential groove 118 formed in the surface. Post 110 includes a threaded hole 120 offset toward the second end and a pivot pin hole 122 at the approximate midpoint of the post. Post 110 extends through openings 104 and 106 of block 94.

Figure 15:
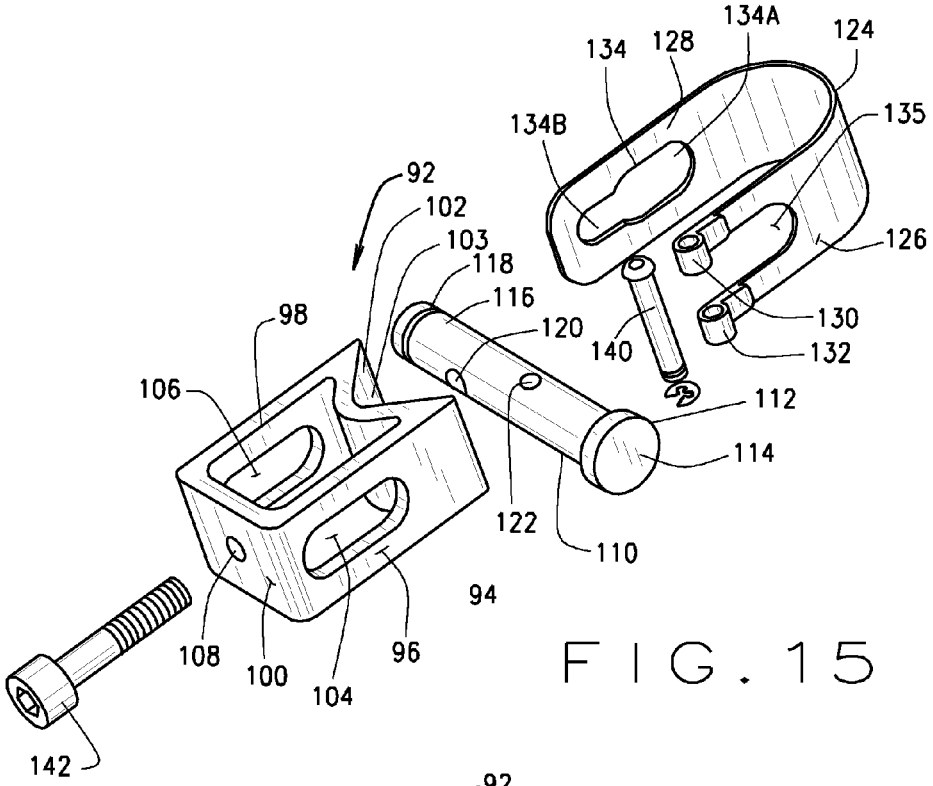
FIG. 15 is an exploded view thereof.
Figure 16:
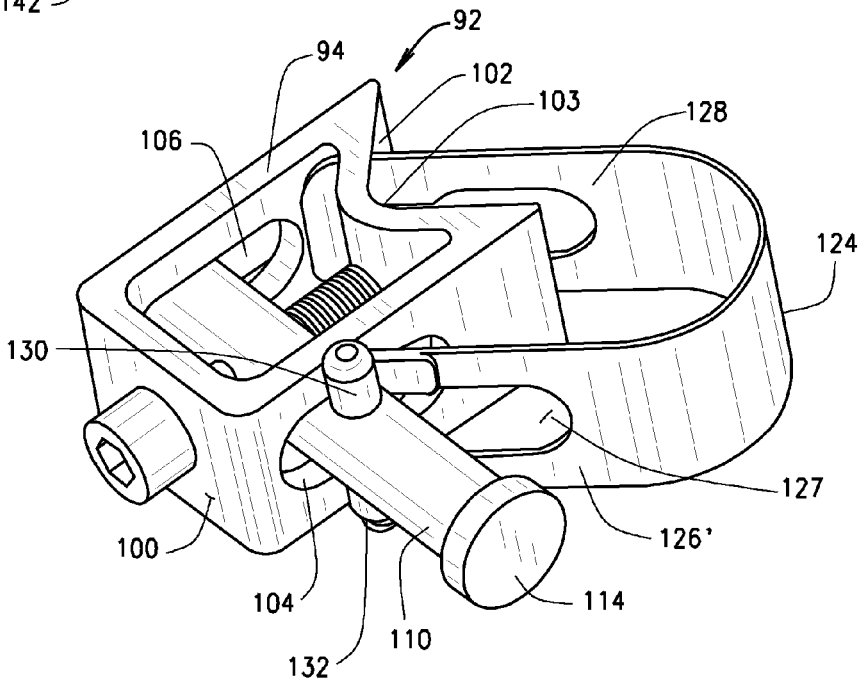
FIG. 16 is an enlarged view thereof showing the flexible band in a partially rotated position.

The mounting post assembly includes a flexible, generally C-shaped band 124. Band 124 includes a first arm 126 and a second arm 128. The first arm includes an elongated, open ended slot 127 and a pair of linearly aligned pin sleeves 130 and 132. The second arm includes an elongated opening 134 that has a major width 134A and a minor width 134B. The first arm of band 124 is attached to the approximate midpoint of post 110 by a pivot pin 140 that extends through the pin sleeves 130 and 132 and engages hole 122 in the post. A threaded fastener 142 extends through hole 108 and engages threaded hole 120 of the post. As shown in FIG. 15, band 124 can be opened by rotating the band around the pivot pin 140. Open ended slot 127 allows the band to rotate to an open position without abutting the post. The opened band allows the assembly to be attached to a wheelchair cane C1. The band is then pivoted back around the cane until the second end of post 110 is engaged in opening 134 of the second arm of band 124 with circumferential groove 118 secured in the miner width 138 of the opening to secure the band in place. Fastener 142 then is rotated, urging block 94 toward the cane until the assembly is tightly secured to the cane.

Figure 17:
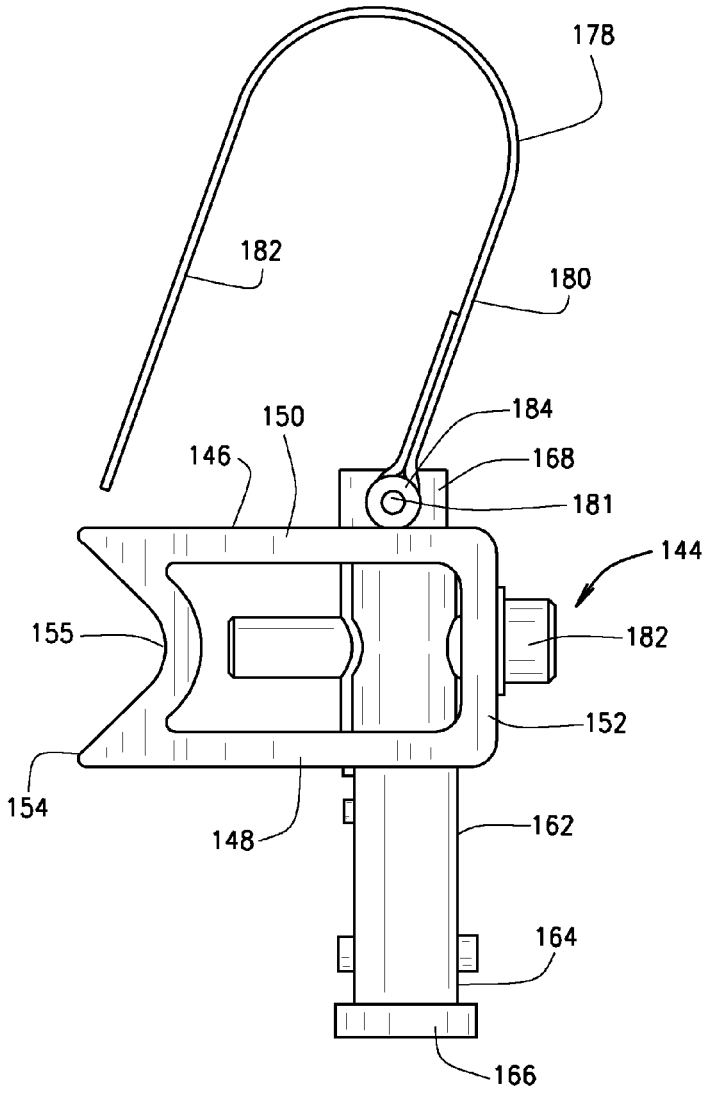
FIG. 17 is a top plan view of another embodiment of a mounting clamp assembly and support post with the flexible band in rotated to an open position.
Figure 18:
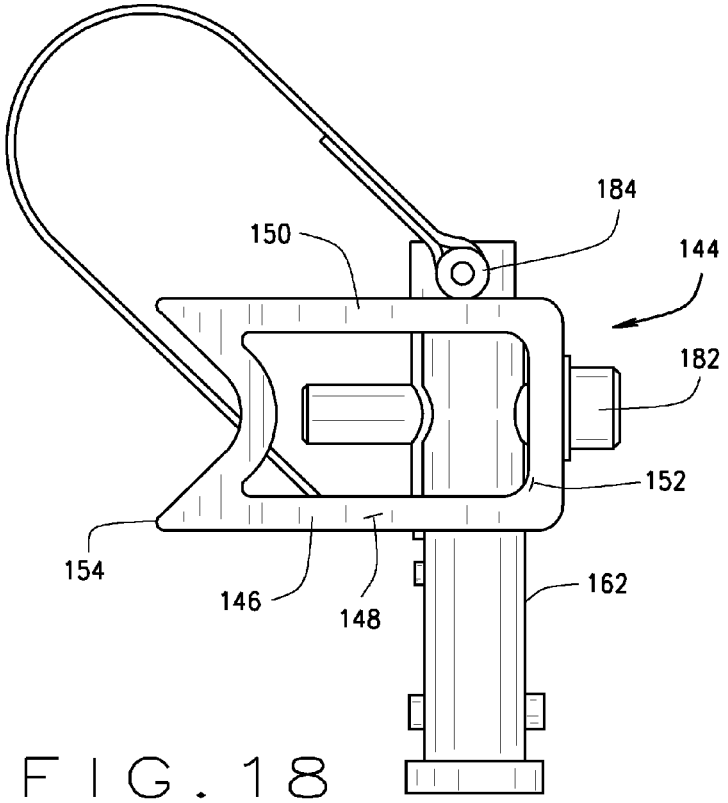
FIG. 18 is a top plan view thereof with the flexible band rotated to a partially closed position.
Figure 19:
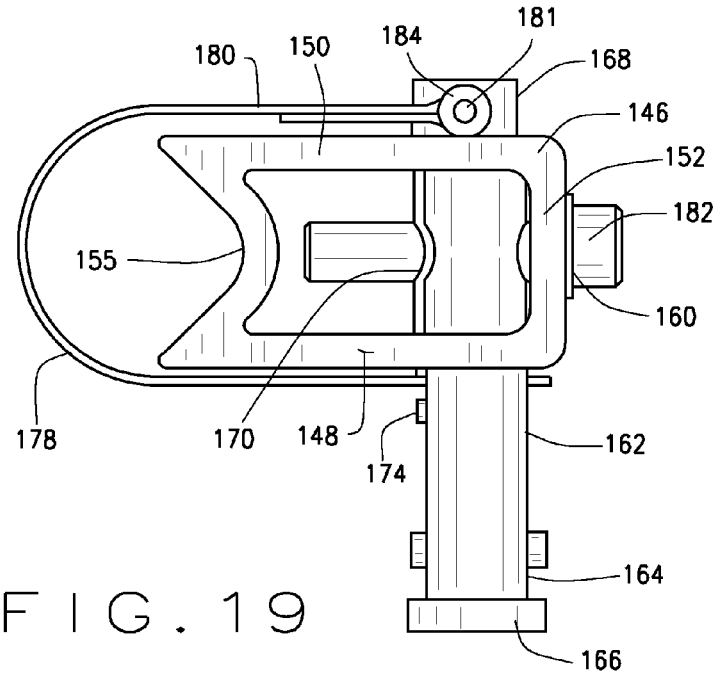
FIG. 19 is a top plan view thereof with the flexible band rotated to a closed position.

FIGS. 17 through 19 illustrate another embodiment of a mounting post assembly of the present invention, indicated generally by reference number 144. Mounting post assembly 144 generally comprises a block 146 having a first side wall 148, a second side wall 150, a rear wall 152 and a forward wall 154. The forward wall has a substantially V-shaped cross-section defining indention 155. The first and second side walls include aligned, complementary elongated openings similar to those previously described in reference to block 94. There is an opening or hole 160 in the rear wall. Opening 160 can be threaded or smooth. Assembly 144 further includes a post 162 having a first end 164 with a knob 166 and a second end 168. Post 162 includes a threaded hole 170 offset toward the second end and a pivot pin hole (not seen) at the extreme second end. Post 162 includes at least one detent 174 on the surface at the approximate mid point.

The mounting post assembly includes a flexible, generally C-shaped band 178. Band 178 includes a first arm 180 and a second arm 182. The first arm includes a pair of linearly aligned pin sleeves 184. Although not seen in the drawings band 178 is constructed similarly to band 124 previously describe, having a second arm with an elongated opening that has a major width and a minor width. The first arm 180 of band 178 is attached to the end of post 162 by a pivot pin 181 that extends through the pin sleeves and engages a hole in the post. A threaded fastener 182 extends through hole 160 and engages threaded hole 170 of the post. As shown in FIGS. 17 and 18, band 178 can be opened by rotating the band around the pivot pin 181. The opened band allows the assembly to be attached to a wheelchair cane. The band is then pivoted back around the cane until the opening in the second arm of the band is secured around the post at detents 174 to secure the band in place. Fastener 182 then is rotated until the assembly is tightly secured to the cane.

It will be appreciated that in the various embodiments of the post mounting assemblies the pivotal connection of the flexible band to the barrel pin or posts serves an important purpose of eliminating loose parts that can become disengaged and dropped or even lost, which may be particularly burdensome for an individual confined to a wheelchair. It will be noted that a pair of mounting post assemblies 92 and 142 can be attached to a cane at an appropriate linear distance apart, as seen in FIG. 3, to allow the attachment of an attachment assembly of the present invention to an upper post and a lower post.

The foregoing description and accompanying drawings are intended to be illustrative only and should not be construed in a limiting sense.

The invention claimed is:

1. A mounting clamp assembly for use with a support mechanism for mounting a wheelchair back to a wheelchair post, the mounting clamp assembly comprising:

a band mechanism operatively connectable to a wheelchair post, the band mechanism comprising a clamp block having a rear surface defining a hole, a forward surface, a first side surface and a second side surface; the first and second side surfaces having aligned openings;

a band having opposed arms; the band extending around the forward surface of the clamp block to define a space between the clamp block forward surface and the band to accommodate a wheelchair post;

a pin extending along its longitudinal axis through the aligned openings of the clamp block, the pin being pivotally connected to one arm of the band by a pivot element extending through the pin on a pivot axis perpendicular to the longitudinal axis of the pin such that the band can pivot about the pin to extend around the forward surface of the clamp block and the wheelchair post or pivot away from the forward surface of the clamp block and the wheelchair post, the pin having a bore in functional alignment with the hole in the rear surface of the clamp block; at least one of the pin bore and the hole in the rear surface being threaded;

a clamp fastener extending through the clamp block rear surface hole and being operatively engaged with the bore of the pin, whereby rotation of the fastener in a first direction draws the connected band toward the forward surface of the clamp block to reduce the size of the space between the band and the clamp block forward surface in order to secure the wheelchair post between the band and the forward surface of the clamp block, and rotation of the fastener in an opposite direction moves the band away from the forward surface of the block; and a support post extending from the clamp block, the support post providing at least one point of support for a support mechanism for mounting a wheelchair back to the wheelchair post.

2. The mounting clamp assembly of claim 1 wherein the clamp block further comprises a second support post in vertical alignment with said first recited support post.

3. A mounting clamp assembly for use with a support mechanism for mounting a wheelchair back to a wheelchair post, the mounting clamp assembly comprising:

an elongated body having an upper block segment and a lower block segment;

an adjustable band mechanism at the upper block segment, the adjustable band mechanism comprising an adjustable pin extending along its longitudinal axis through the clamp block, and a band having a pair of opposed arms, with one of said arms being pivotably attached to a first end of the adjustable pin by a pivot element extending through the adjustable pin on a pivot axis perpendicular to the longitudinal axis of the adjustable pin the band extending around the clamp block to define a space between the clamp block and the band for engagement of a wheelchair post, the band pivotable to a first position wherein it extends around the wheelchair post and to a second position wherein it is disengaged from the wheelchair post;

a first support post extending laterally from the clamp block, the first support post providing at least one point of support for a support mechanism for mounting a wheelchair back to the wheelchair post; and a second laterally extending support post at the lower block segment providing at least one other point of support for a support mechanism for mounting a wheelchair back to the wheelchair post;

wherein adjustment of the adjustable pin block effects tightening or loosening of the band around the wheelchair post.

4. The mounting clamp assembly of claim 3 wherein the adjustable pin comprises an adjustment screw in a threaded hole, whereby actuation of the adjustment screw in a first direction moves the adjustable pin forward and actuation in a second direction moves the adjustable pin block backwards.

5. The mounting clamp assembly of claim 3 wherein the other of the opposed arms of the band is releasably secured to a second end of the adjustable pin.

* * * * *